US012774848B2

(12) United States Patent
Lyu et al.

(10) Patent No.: US 12,774,848 B2
(45) Date of Patent: Oct. 27, 2026

(54) VACUUM STORAGE DEVICE AND REFRIGERATOR

(71) Applicants: QINGDAO HAIER SPECIAL REFRIGERATION ELECTRIC APPLIANCE CO., LTD., Qingdao (CN); QINGDAO HAIER REFRIGERATOR CO., LTD., Qingdao (CN); HAIER SMART HOME CO., LTD., Qingdao (CN)

(72) Inventors: Peng Lyu, Qingdao (CN); Hao Zhang, Qingdao (CN); Honghui Liu, Qingdao (CN); Tong Xu, Qingdao (CN)

(73) Assignees: QINGDAO HAIER SPECIAL REFRIGERATION ELECTRIC APPLIANCE CO., LTD., Qingdao (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 376 days.

(21) Appl. No.: 18/568,689

(22) PCT Filed: May 27, 2022

(86) PCT No.: PCT/CN2022/095652

§ 371 (c)(1),
(2) Date: Dec. 8, 2023

(87) PCT Pub. No.: WO2022/257784

PCT Pub. Date: Dec. 15, 2022

(65) Prior Publication Data

US 2024/0271861 A1 Aug. 15, 2024

(30) Foreign Application Priority Data

Jun. 11, 2021 (CN) ..... 202110653877.0

(51) Int. Cl.
*F25D 25/00* (2006.01)
*F25D 17/04* (2006.01)

(52) U.S. Cl.
CPC ..... *F25D 25/005* (2013.01); *F25D 17/045* (2013.01); *F25D 2317/043* (2013.01)

(58) Field of Classification Search
CPC ..... F25D 25/00; F25D 17/04; F25D 17/042; F25D 25/025; F25D 11/02; F25D 25/005; F25D 17/045; F25D 2317/043
See application file for complete search history.

(56) References Cited

U.S. PATENT DOCUMENTS

2004/0177771 A1* 9/2004 Small ..... A23B 2/103 99/472
2006/0000733 A1* 1/2006 Albritton ..... A47J 41/02 206/432
2007/0095713 A1 5/2007 Schooley

FOREIGN PATENT DOCUMENTS

CN 2624137 Y 7/2004
CN 204925678 U 12/2015
(Continued)

*Primary Examiner* — William C Doerrler
(74) *Attorney, Agent, or Firm* — Muncy, Geissler, Olds & Lowe, P.C.

(57) ABSTRACT

A vacuum storage device includes a suction base, which is provided with a first suction port; a storage box configured to be detachably fixed to the suction base, defining a storage space within; where the storage box has a suction port; a vacuum pump configured to sequentially extract part or all of the air from the storage space through the first suction port and the suction port. The vacuum storage device allows for easy retrieval of ingredients into the storage, enhancing the user experience. There is also provided a refrigerator having the vacuum storage device.

8 Claims, 10 Drawing Sheets

(56) References Cited

FOREIGN PATENT DOCUMENTS

| | | | | | |
|---|---|---|---|---|---|
| CN | 105383807 | A | | 3/2016 | |
| CN | 105966771 | A | | 9/2016 | |
| CN | 108945821 | A | | 12/2018 | |
| CN | 109068895 | A | | 12/2018 | |
| CN | 209090830 | U | | 7/2019 | |
| CN | 110603199 | A | | 12/2019 | |
| CN | 111473577 | A | | 7/2020 | |
| CN | 111493707 | A | | 8/2020 | |
| CN | 111578588 | A | | 8/2020 | |
| CN | 212354597 | U | | 1/2021 | |
| CN | 113340042 | A | | 9/2021 | |
| CN | 215638229 | U | | 1/2022 | |
| CN | 216409482 | U | | 4/2022 | |
| KR | 20060041507 | A | * | 5/2006 | ..... F25D 23/04 |
| WO | WO-2017042801 | A1 | * | 3/2017 | ..... B65D 81/2038 |
| WO | WO-2018189351 | A1 | * | 10/2018 | ..... B65D 51/1683 |
| WO | WO-2021223284 | A1 | * | 11/2021 | ..... F25D 29/005 |

* cited by examiner

VACUUM STORAGE DEVICE AND REFRIGERATOR

FIELD OF THE INVENTION

This invention relates to the field of refrigerating and freezing technology, in particular to a vacuum storage device and a refrigerator.

BACKGROUND OF THE INVENTION

With the improvement in living standards, the demand for refrigerators has increased significantly. To enhance the freshness of refrigerators, the existing technology has introduced vacuum-equipped refrigerators, which have become popular among consumers. These refrigerators operate by using a vacuum pump to create a vacuum in a compartment of the refrigerator. However, this design has made it inconvenient to place and take out food items, and the components of the vacuum preservation part are not optimally arranged, resulting in reduced effective volume of the refrigerator.

BRIEF DESCRIPTION OF THE INVENTION

One objective of this invention is to overcome at least one of the problems in existing technology by providing a vacuum storage device that facilitates the storage of food items.

A further objective is to provide a vacuum storage device that is easy to vacuum and effective in preservation.

This vacuum storage device of the invention comprises a suction base and a storage box, forming a first suction port on the suction base and a suction port on the storage box, enabling the suction component and the item to be vacuumed.

Further, the storage box of the vacuum storage device of the present invention comprises an inner box and an outer box, and by setting the outer box outside the inner box and having a gap between the inner box and the inner box, an suction port is formed on the outer box, so as to make the vacuum pump pump out part or all of the gas in the storage space in sequence via the first suction port, the extraction port, and the gap, and to avoid blocking the suction port by dropping the food ingredients in the storage space.

According to the detailed description of the specific embodiments of the present invention hereinafter in conjunction with the accompanying drawings, the person skilled in the art will be more aware of the above and other purposes, advantages and features of the present invention.

DETAILED DESCRIPTION

Figure 1:
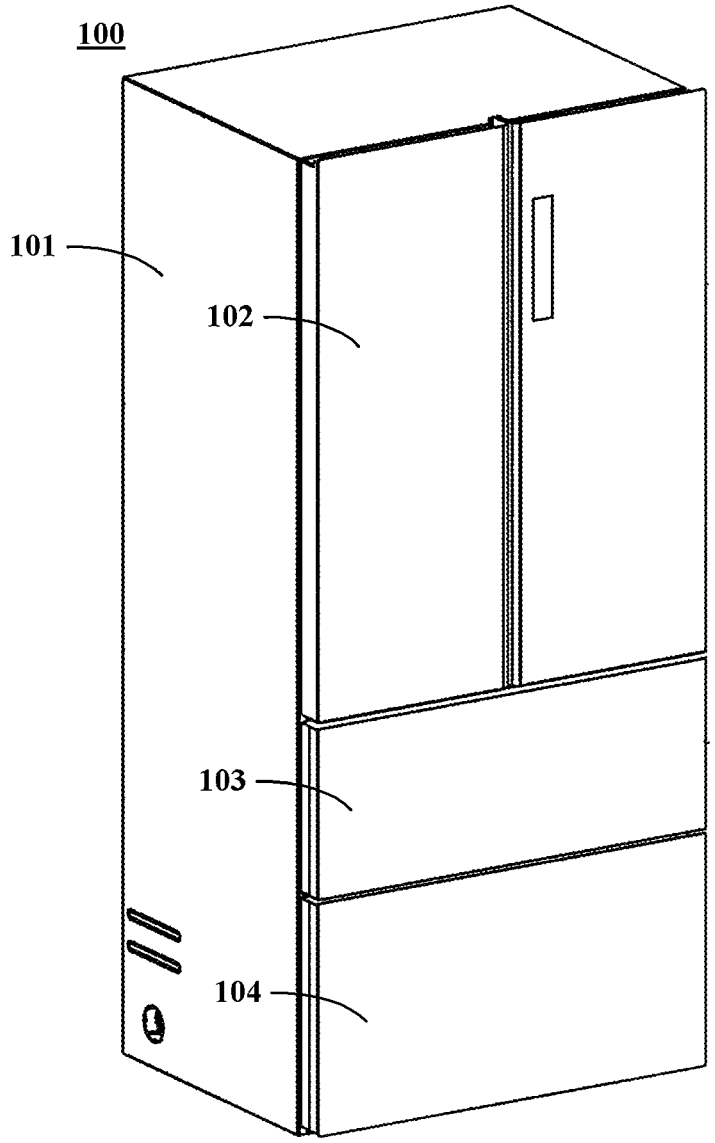
FIG. 1 is a schematic of a refrigerator with a vacuum storage device according to an embodiment of the invention.
Figure 2:
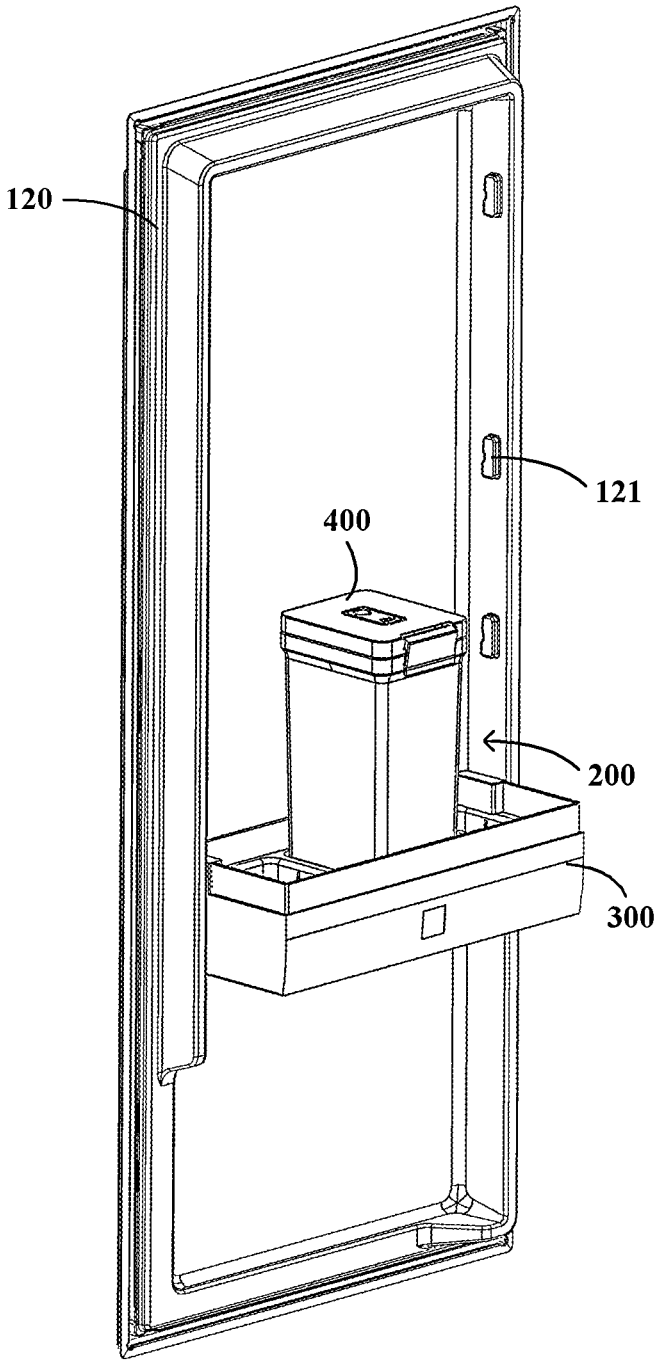
FIG. 2 is a schematic of the door liner and vacuum storage device of the refrigerator shown in FIG. 1.
Figure 3:
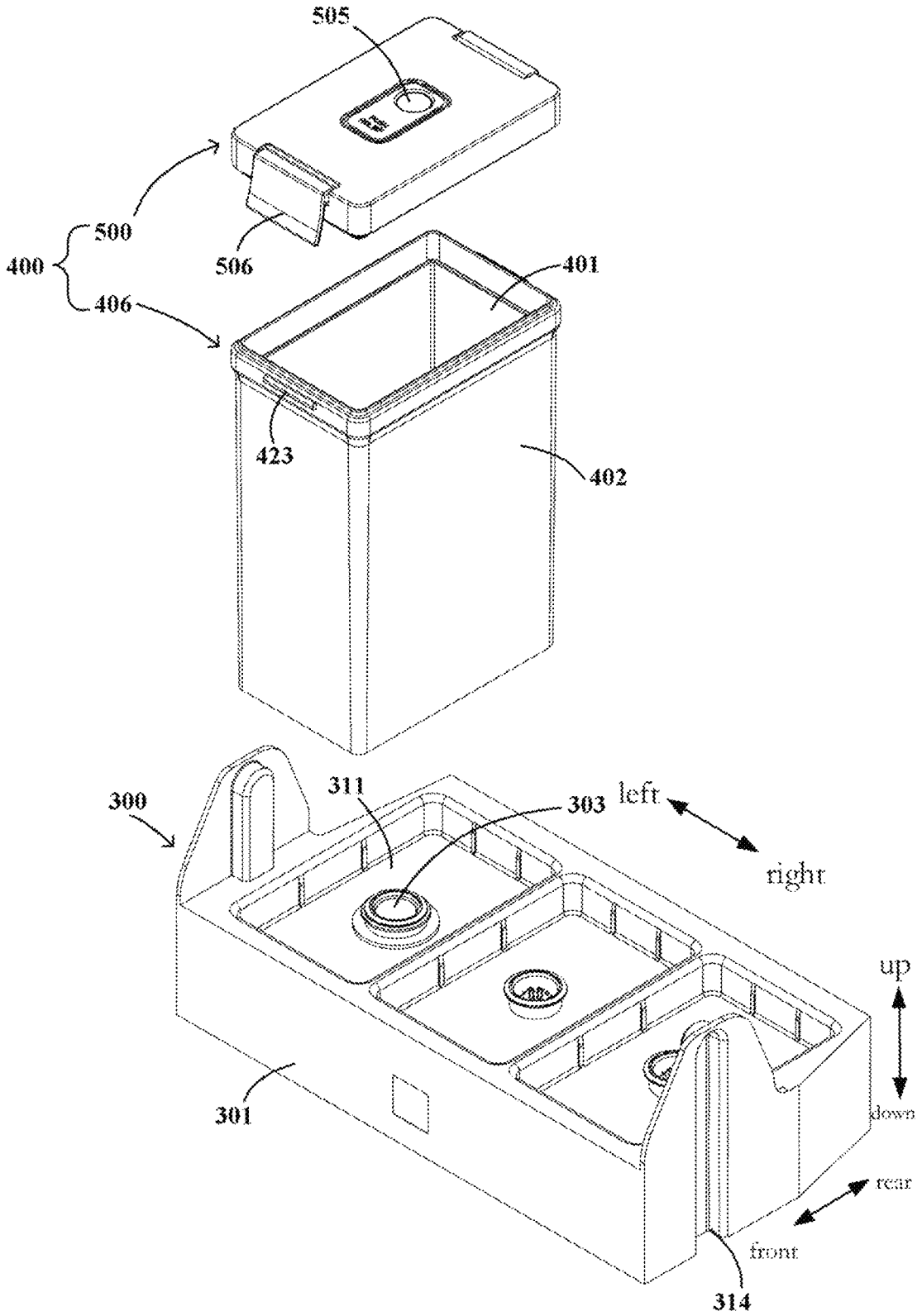
FIG. 3 is an exploded schematic of the vacuum storage device according to an embodiment of the invention.
Figure 4:
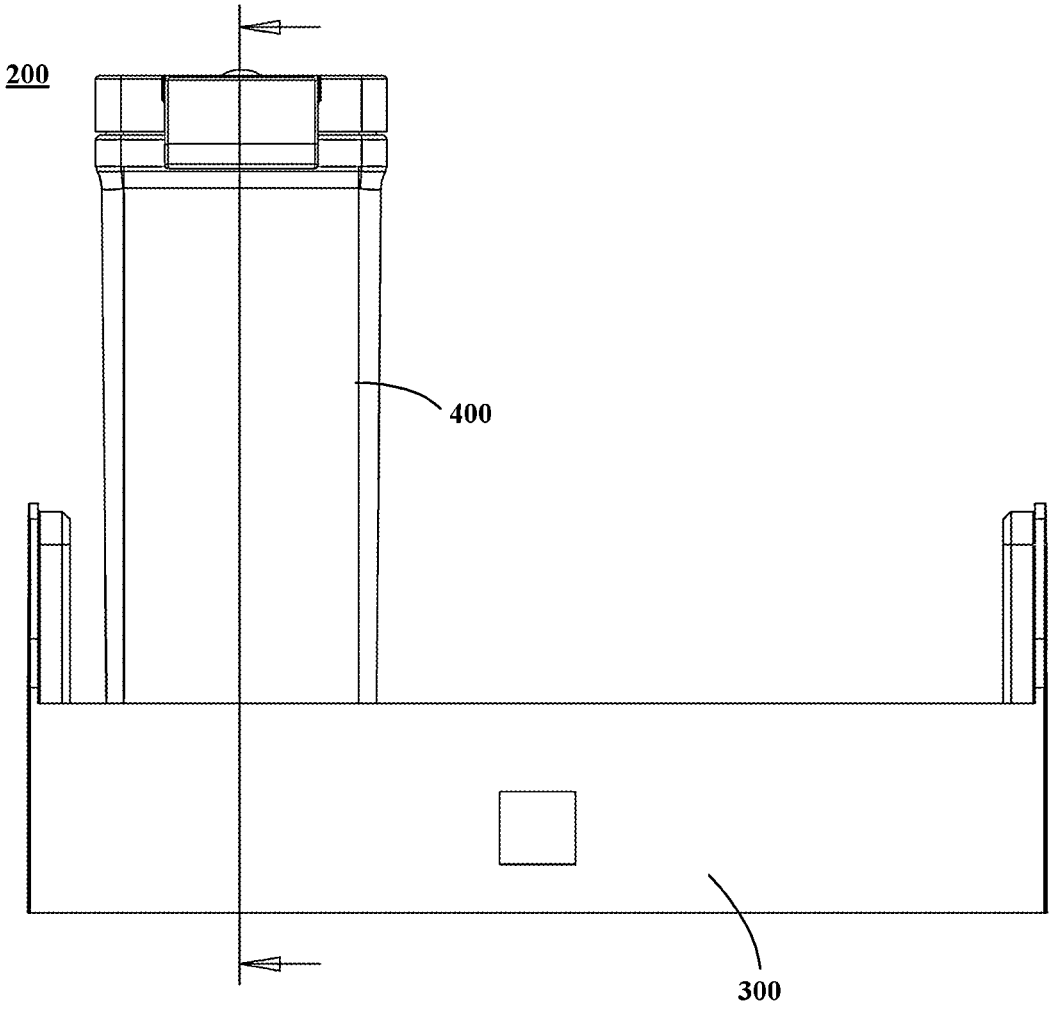
FIG. 4 is a schematic of the vacuum storage device shown in FIG. 3.
Figure 5:
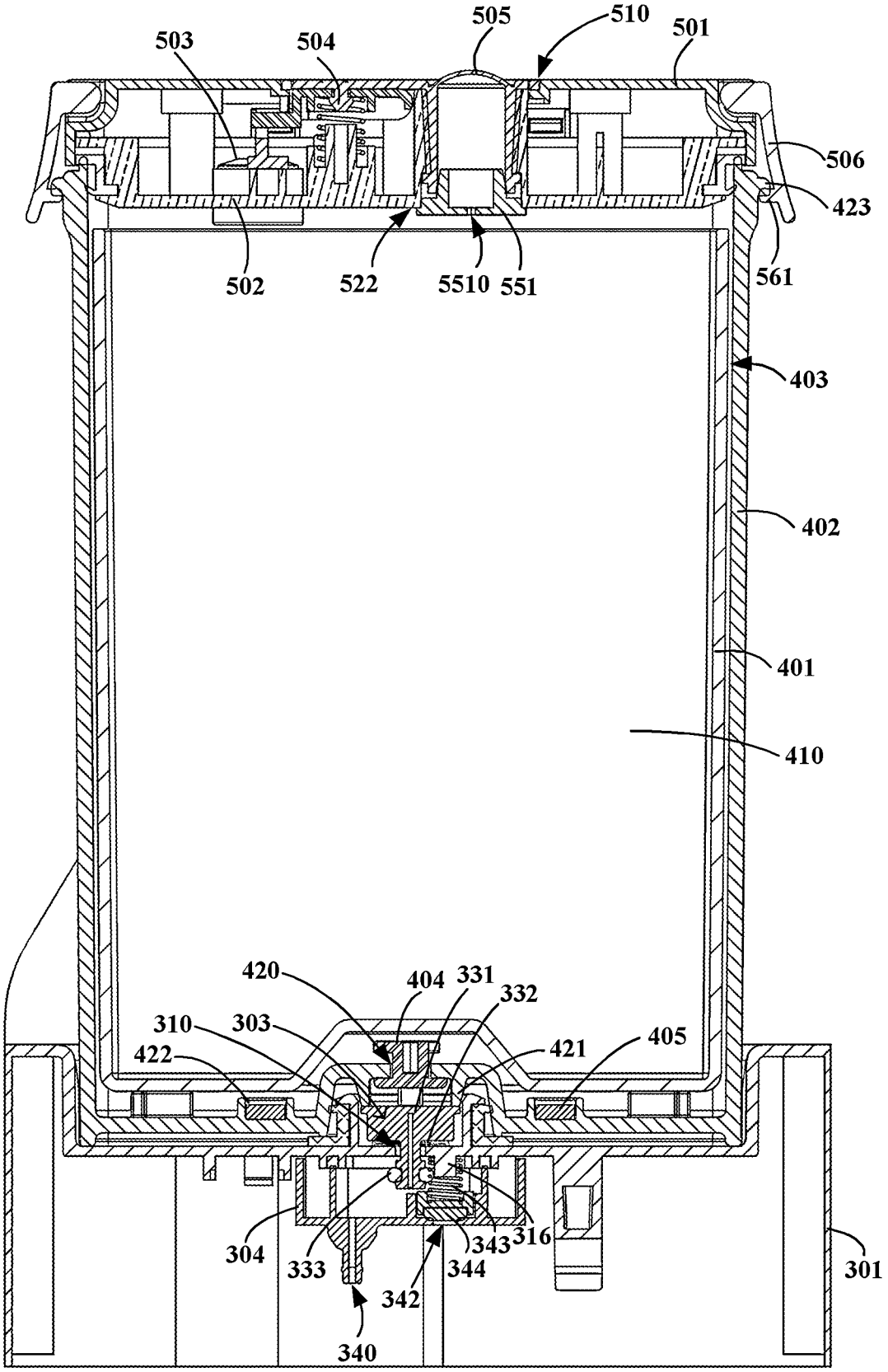
FIG. 5 is a sectional view of the vacuum storage device shown in FIG. 3.

FIG. 1 is a schematic diagram of a refrigerator 100 having a vacuum storage device 200 of one embodiment of the present invention. FIG. 2 is a schematic diagram of the door liner 120 and the vacuum storage device 200 of the refrigerator 100 shown in FIG. 1. FIG. 3 is a schematic diagram of an exploded decomposition of the vacuum storage device 200 according to an embodiment of the present invention. FIG. 4 is a schematic diagram of the vacuum storage device 200 shown in FIG. 3. FIG. 5 is a schematic diagram of an exploded view of the vacuum storage device 200 shown in FIG. 3.

The embodiment of the invention provides a refrigerator 100 which generally comprises a cabinet 101, a door 102, and a vacuum storage device 200. The cabinet 101 comprising at least one front-side open storage compartment, usually multiple, such as a refrigerating chamber, a freezing chamber, and a variable temperature chamber. The number and function of specific storage compartments can be configured according to pre-established needs. The preservation temperature of the refrigerating chamber can be 2-9° C., or 4-7° C.; the preservation temperature of the freezing chamber can be −22 to −14° C. The variable temperature chamber can be adjusted according to needs to store suitable food or serve as a freshness storage chamber. In the refrigerator 100 shown in FIG. 1, the front side of the refrigeration chamber is provided with a pivoting door 102, the first drawer 103 is the variable temperature chamber, and the second drawer 104 is the freezing chamber. The storage compartments are cooled by a compression refrigeration system. The vacuum storage device 200 is provided on the inner side of the door 102, the suction base 300 fixed to the door liner 120 of the door 102. The vacuum storage device 200 provides a sealed space for precious food items (such as *ginseng*, sea cucumber, goji berries, tonic herbs, seasonings, etc.), and performs vacuum processing in the sealed space to reduce oxidation and deterioration, and prevent food flavors from mingling. At the same time, since the vacuum storage device 200 is provided on the inner side of the door 102, it is convenient for users to access at any time, without needing to reach deep into the cabinet 101 to place or take out food. As depicted in FIG. 2, the inner surface of the door liner 120 comprises is provided with ears 121, and the suction base 300 of the vacuum storage device 200 forms a hanging slot 314, which is fitted onto the hanging ears 121 to install the vacuum storage device 200 on the inner side of the door 102.

As shown in FIG. 3, the vacuum storage device 200 of the embodiment of the invention generally comprises: a suction base 300 and a storage box 400. The suction base 300 forms a first suction port 310. The storage box 400 is configured to be detachably fixed to the suction base 300, a storage space 410 defined within the storage box 400; the storage box 400 provides with a suction port 420. The vacuum pump 302 is configured to sequentially extract part or all of the air from the storage space 410 through the first suction port 310 and the suction port 420. The vacuum storage device 200 of this embodiment, by providing the suction base 300 and the storage box 400, forms a first suction port 310 on the suction base 300 and a suction port 420 on the storage box 400, allowing the suction component and the device to be vacuumed to be separately provided. The same suction base 300 can be applied to a variety of storage boxes 400, enabling a broader range of applications. Additionally, the storage box 400 is detachably fixed to the suction base 300, enabling easy placement and take out of food items into and from the storage box 400, enhancing the user experience.

In some embodiments, the suction base 300 defines an accommodation space, with the vacuum pump 302 located within this space. By positioning the vacuum pump 302 inside the suction base 300, the suction components are integrated into one unit, and the assembly of the vacuum pump 302 is more convenient.

As illustrated in FIGS. 4 to 5, in some embodiments of this invention, the storage box 400 comprises an inner box 401 and an outer box 402. The inner box 401 defines a storage space 410; the outer box 402 is fitted over the inner box 401 and has a gap 403 between the outer box 402 and the inner box 401. The outer box 402 is provided with a suction port 420, and the vacuum pump 302 sequentially extracts part or all of the air from the storage space 410 through the first suction port 310, the suction port 420, and the gap 403. This design prevents food items in the storage space 410 from falling and blocking the suction port 420. As shown in FIG. 3, the storage box 400 comprises a box portion 406 and a lid 500, where the box portion 406 comprises the inner box 401 and the outer box 402.

Figure 6:
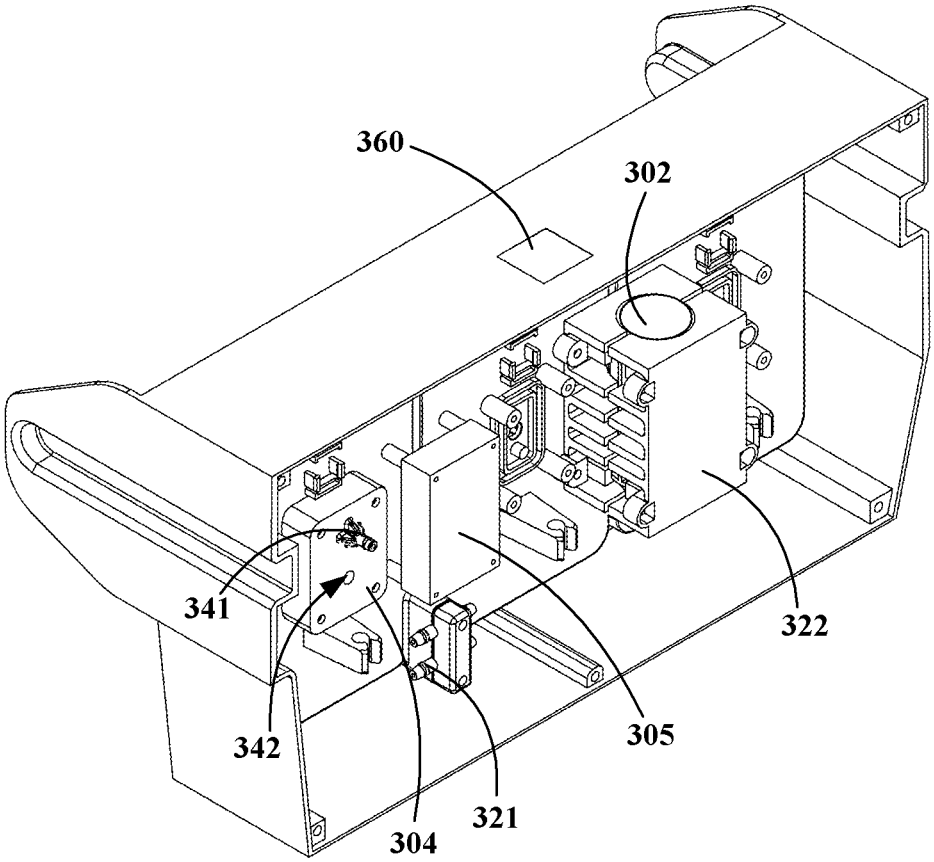
FIG. 6 is a schematic of the suction base of the vacuum storage device shown in FIG. 3.
Figure 7:
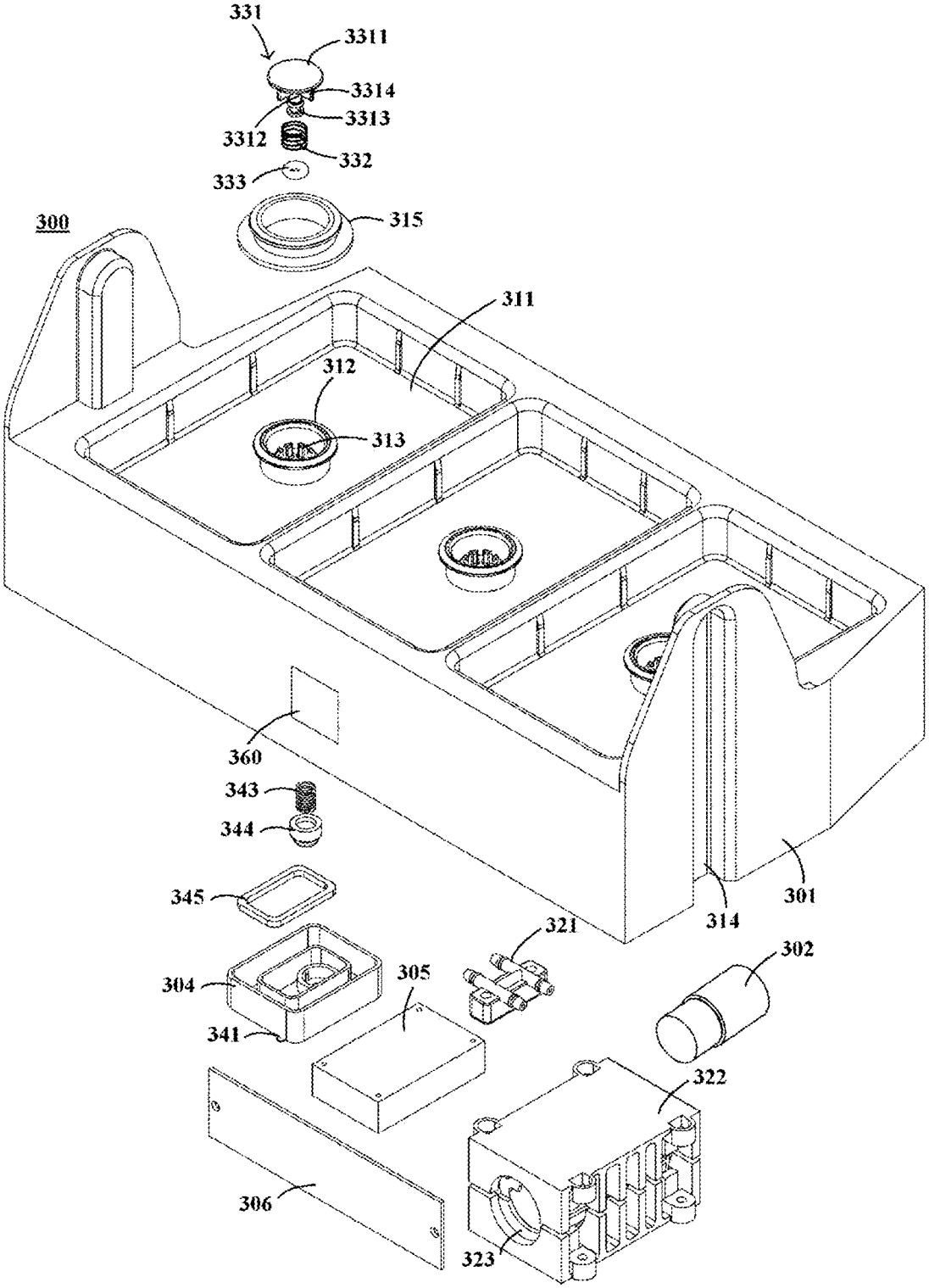
FIG. 7 is an exploded view of the suction base of the vacuum storage device shown in FIG. 6.

FIG. 6 is a schematic of the suction base 300 of the vacuum storage device 200 shown in FIG. 3. FIG. 7 is an exploded view of the suction base 300 of the vacuum storage device 200 shown in FIG. 6. In some embodiments of this invention, the top wall of the suction base 300 is provided with a first suction port 310. The suction base 300 also comprises a base suction switch 303, located at the first suction port 310, and is configured such that when the storage box 400 is placed at the first suction port 310, the base suction switch 303 moves downward due to the weight of the storage box 400 and forms a suction channel with the first suction port 310; when the storage box 400 is removed from the suction base 300, the base suction switch 303 moves upward and closes the first suction port 310. As shown in FIGS. 5 and 7, the suction base 300 comprises a base body 301, a first suction port 310 opened on the top wall of the base body 301. As shown in FIG. 3, the base body 301 forms multiple placement slots 311, each slot 311 having a first suction port 310, corresponding to a storage box 400. The suction base 300 of the embodiment of the present invention is configured to form a suction channel between the storage box 400 and the first suction port 310 based on the weight of the storage box 400 when the storage box 400 is placed at the first suction port 310, and the base suction switch 303 is moved upwardly to close the first suction port 310 when the storage box 400 is removed, so that the opening and closing structure of the first suction port 310 of the suction base 300 is very clever, and the opening and closing of the first suction port 310 are associated with the placement of the storage box 400, which can avoid the problem of particles and other debris entering the suction base 300 due to the exposure of the first suction port 310 when the storage box 400 has not been placed, and the internal cleanliness of the air extraction base 300 can be maintained for a long time.

Referring to FIGS. 5 to 7, in some embodiments of this invention, the base suction switch 303 of the suction base 300 comprises a valve 331, a first spring 332, and a first sealing ring 333. The valve 331 has a horizontal part 3311 and a vertical part 3312 extending downward from the horizontal part 3311. The vertical part 3312 of the valve 331 passes through the first suction port 310, with an outer diameter smaller than the inner diameter of the first suction port 310 and forming an annular groove 3313 at the bottom. The first spring 332 is fitted around the outside of the vertical part 3312 of the valve 331 and is sandwiched between the horizontal part 3311 of the valve 331 and the top wall of the suction base 300. The first sealing ring 333 is fitted inside the annular groove 3313 and has an outer diameter larger than the inner diameter of the first suction port 310. The design of the base suction switch 303, comprising the valve 331, the first spring 332, and the first sealing ring 333, facilitates easy configuration and low cost. When the storage box 400 is placed inside the suction base 300, the valve 331 of the base suction switch 303 moves downward under the weight of the storage box 400, compressing the first spring 332, and moving the first sealing ring 333 downward, opening the first suction port 310. The smaller outer diameter of the vertical part 3312 compared to the inner diameter of the first suction port 310 forms a suction channel between the vertical part 3312 and the first suction port 310. When the storage box 400 is removed from the suction base 300, the first spring 332 rebounds upward, moving the first sealing ring 333 upward and sealing the gap between the first suction port 310 and the vertical part 3312, thereby closing the first suction port 310.

As shown in FIG. 7, the top wall of the base 301 extends upward beyond the first suction port 310 to form an annular ridge 312, with multiple first locking protrusions 313 provided at intervals around the first suction port 310 between the annular ridge 312 and the first suction port 310, defining locking slots (unnumbered in the figure) between adjacent protrusions. The upper part of the vertical section 3312 of the valve 331 is provided with multiple second locking protrusions 3314 at intervals around its circumference, which fit into the locking slots. The setting of the annular ridge 312 on the top wall of the base body 301 allows the base suction switch 303 to be fitted within the space defined by the annular ridge 312 and the base 301, and the combination of the second locking protrusions 3314 and the locking slots prevents the displacement of the base suction switch 303. Additionally, as referenced in FIGS. 3 and 8, the bottom wall of the outer box 402 can also form a raised area 424, the a raised area 424 corresponding to the structure of the annular ridge 312, which partially matches with the annular ridge 312 to allow the storage box 400 to be placed more accurately and quickly on the suction base 300. Furthermore, a sealing ring 315 is also provided outside the annular ridge 312 to maintain the seal between the outer box 402 and the suction base 300.

Continuing with reference to FIG. 7, in some embodiments of this invention, the suction base 300 further comprises a suction box 304, located inside the base body 301 and fastened below the first suction port 310. The suction box 304 is provided with a docking head 341, the docking head 341 is provided with a second suction port 340; the vacuum pump 302 is connected to the docking head 341 via a suction pipeline 321. The incorporation of the suction box 304 facilitates an easier connection between the vacuum pump 302 and the first suction port 310. When there are multiple first suction ports 310 in the suction base 300, corresponding multiple suction boxes 304 are provided. For instance, if there are three first suction ports 310 in the suction base 300, there would be three corresponding suction boxes 304. FIG. 7 illustrates only the cross structure of the multiple suction pipelines 321 connecting the three suction boxes 304 to the vacuum pump 302. Additionally, a sealing ring 345 may be positioned between the top wall of the suction box 304 and the underside of the top wall of the base body 301 to ensure a seal between the suction box 304 and the base 301.

In some embodiments, the bottom wall of the suction box 304 in the suction base 300 is provided with an overpressure vent 342; the suction box 304 also provides with a second spring 343 and a sealing pad 344, where the sealing pad 344 is positioned at the overpressure vent 342, and one end of the second spring 343 abuts the inside of the top wall of the base body 301, with the other end abutting the sealing pad 344. The vacuum storage device 200 of this embodiment can be set to vacuum at regular intervals, that is, pumping for a certain amount of time at regular intervals. But various factors, such as the volume of food in the storage space 410, the temperature of the gas, and the order of vacuuming, can affect the vacuuming time, potentially leading to excessive vacuum. By providing the overpressure vent 342 on the bottom wall of the suction box 304, it helps protect the structural components and elements of the vacuum storage device 200, controls the air pressure stability, and avoids issues of excessive negative pressure during the vacuuming of the storage box 400. Specifically, when the internal air pressure in the suction box 304 falls below the rated pressure, the second spring 343 is pushed upwards by the external atmospheric pressure, moving the sealing pad 344 upwards and opening the overpressure vent 342, allowing the internal air pressure in the suction box 304 to stabilize at the rated pressure, thus preventing excessive negative pressure during vacuuming of the storage box 400. This design ensures that even with regular interval vacuuming in the vacuum storage device 200, there is no concern of excessive vacuum, and the overpressure vent structure requires minimal space, is cost-effective, and offers a high value for money. Additionally, to limit the position of the second spring 343, a positioning post 316 extends downward from the inside of the top wall of the base 301 at the location corresponding to the second spring 343.

The suction base 300 of this embodiment may also comprise an elastic shock-absorbing seat 322, positioned inside the base 301 and spaced apart from the suction box 304, the elastic shock-absorbing seat 322 is provided with a containment cavity 323, in which the vacuum pump 302 is installed. The introduction of the elastic shock-absorbing seat 322 can reduce the noise generated by the vacuum pump 302.

As mentioned earlier, the vacuum storage device 200 of this invention can be set to vacuum at regular intervals. Each suction base 300 houses a vacuum pump 302, but can correspond to multiple storage boxes 400. The vacuum storage device 200 of this embodiment can first determine the number of storage boxes 400 on the suction base 300 and then determine the total vacuuming duration based on the number of storage boxes 400 and the vacuuming time for each storage box 400.

In other embodiments, as shown in FIG. 3, one or more magnetic switches (not shown in the figure) are positioned on the top wall of the base 301. Corresponding to the magnetic switches, magnets 405 are located on the bottom wall of the outer box 402. The suction base 300 also comprises a control module 305, placed inside the base body 301 and configured to control the vacuum pump 302 based on the pairing signals from the magnetic switches and the magnets 405. For example, the control module 305 can be set to activate the vacuum pump 302 for a period after detecting the pairing signal between the magnetic switch and the magnet 405.

In yet another embodiment, as shown in FIG. 7, the suction base 300 further comprises a sensing module 306 and a control module 305. The sensing module 306 is located on the front wall of the base body 301 and is used to receive user operations. The control module 305, placed inside the base body 301, is configured to control the vacuum pump 302 based on signals from the sensing module 306. The sensing module 306 can be, for example, a plate-like structure affixed to the front wall of the base body 301, with a sensing button 360 possibly located in the center of the front wall. For instance, the control module 305 can be set to turn the vacuum pump 302 on or off upon sensing a touch action by the user.

Figure 8:
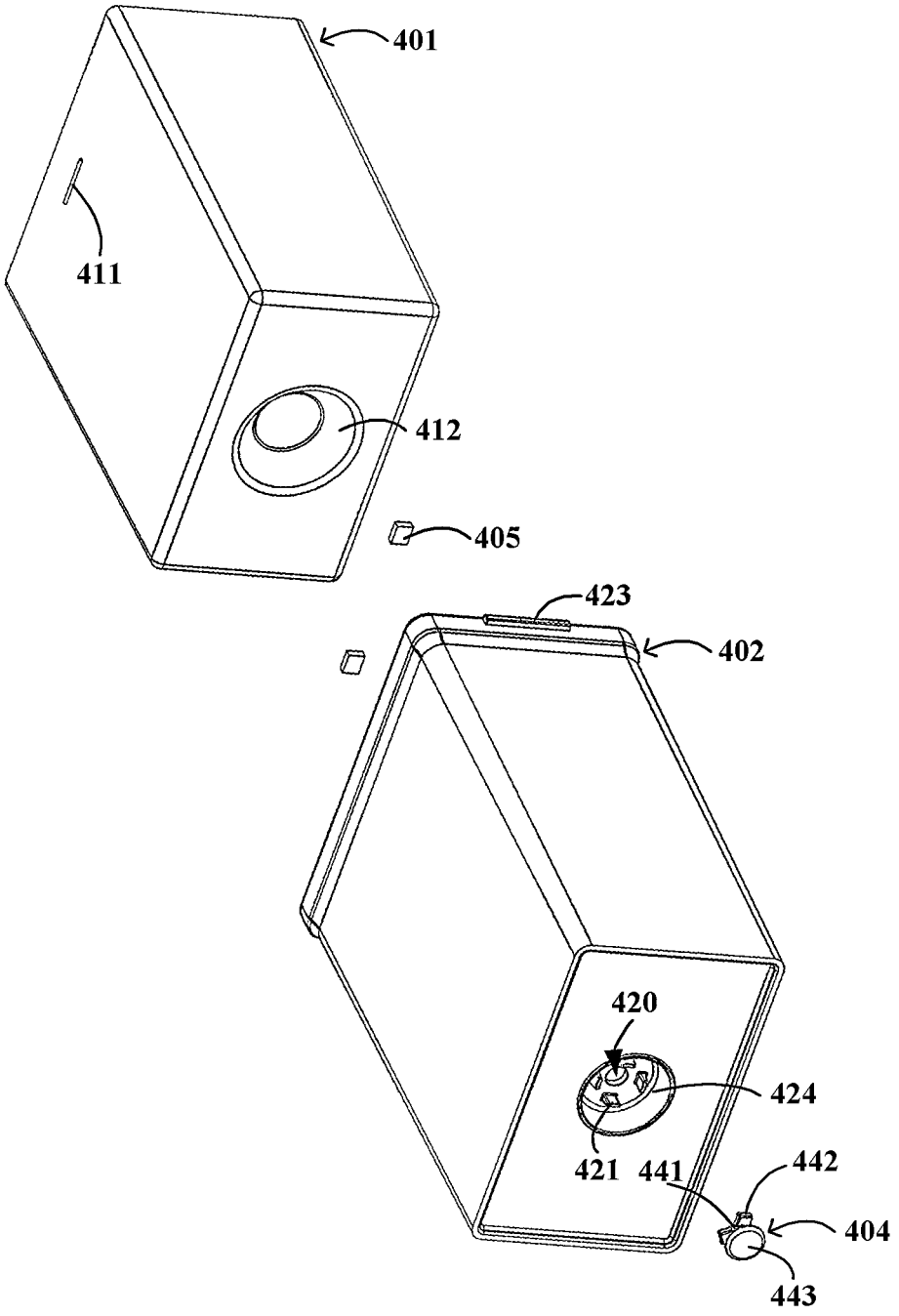
FIG. 8: Exploded view of partial components of the storage box of the vacuum storage device shown in FIG. 3.

FIG. 8 is an exploded view of some components of the storage box 400 of the vacuum storage device 200 shown in FIG. 3. In some embodiments, the outer box 402 of the storage box 400 has a suction port 420 on its bottom wall. The bottom wall of the outer box 402 extends downward around the suction port 420 to form at least one switch protrusion 421, so that when the storage box 400 is placed inside the suction base 300, the switch protrusion 421 contacts and pushes the horizontal part 3311 of the valve 331, moving the base suction switch 303 downward. By forming the switch protrusion 421 around the suction port 420 on the bottom wall of the outer box 402, the engagement structure between the base suction switch 303 and the storage box 400 is simplified, ensuring that the first suction port 310 opens after the storage box 400 is placed into the suction base 300.

As shown in FIG. 8, in some embodiments of this invention, the storage box 400 comprises an outer box 402 with a suction port 420 on its bottom wall. The storage box 400 also comprises a box suction switch 404 positioned at the suction port 420. The box suction switch 404 is an elastic component and is configured such that: when the vacuum pump 302 is activated, the box suction switch 404 moves downward due to suction, forming a suction channel with the suction port 420; after vacuuming is completed, the box suction switch 404 returns upward to its original shape, sealing the suction port 420. The inclusion of the box suction switch 404 ensures that, after vacuuming is complete, the suction port 420 of the storage box 400 remains sealed. The storage box 400 can continue to be placed on the suction base 300, moved to another space inside the refrigerator 100, or even placed outside the refrigerator 100, while still maintaining a vacuum state. This design allows the vacuum storage device 200 to have multiple applications.

In some embodiments, the box suction switch 404 of the storage box 400 comprises a vertical part 441, multiple first horizontal parts 442, and a second horizontal part 443. The vertical part 441 of the box suction switch 404 passes through the suction port 420 and has an outer diameter smaller than the inner diameter of the suction port 420. One end of the vertical part 441 inside the outer box 402 is spaced with multiple first horizontal parts 442, and the other end outside the outer box 402 has a second horizontal part 443. When the storage box 400 is placed inside the suction base 300 and the vacuum pump 302 is turned on, the box suction switch 404 moves downward as a whole, creating a suction channel between the vertical part 441 and the suction port 420, opening the suction port 420. After vacuuming is completed, due to the disappearance of negative pressure in the suction base 300, the negative pressure inside the storage box 400 causes the second horizontal part 443 to tightly adhere to the outer box 402, providing a seal.

Continuing with FIG. 8, the outer box 402 and inner box 401 have a detachable structure. A protrusion 411 is formed on the upper outer side of the inner box 401 to prevent the inner box 401 from wobbling inside the outer box 402. Simultaneously, the bottom wall of the outer box 402 near the suction port 420 area is raised to form a protruding area 424. Correspondingly, the bottom wall of the inner box 401 forms a protruding area 412. The formation of the protruding area 424 on the outer box 402 allows the box suction switch 404 to be accommodated within the protruding area 424 without extending beyond the outer box 402, keeping the bottom wall of the outer box 402 relatively level for easy placement of the storage box 400 and facilitating faster alignment with the suction base 300. Additionally, the outer box 402 also has a groove 422 to accommodate the magnet 405.

Figure 9:
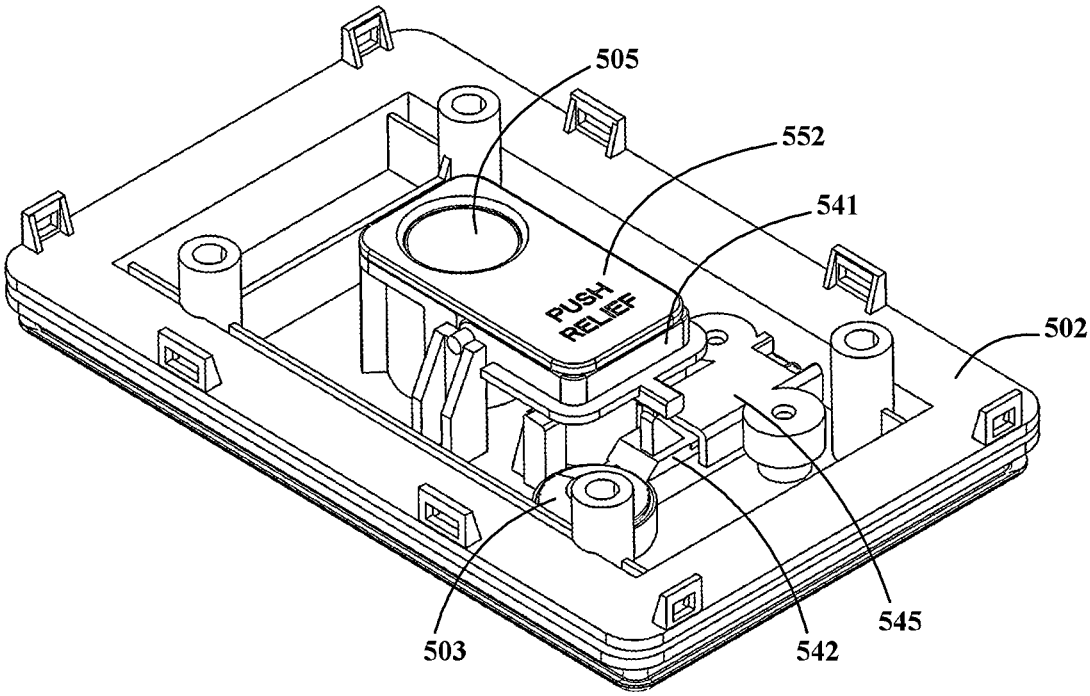
FIG. 9: Schematic of partial components of the lid of the vacuum storage device shown in FIG. 3.
Figure 10:
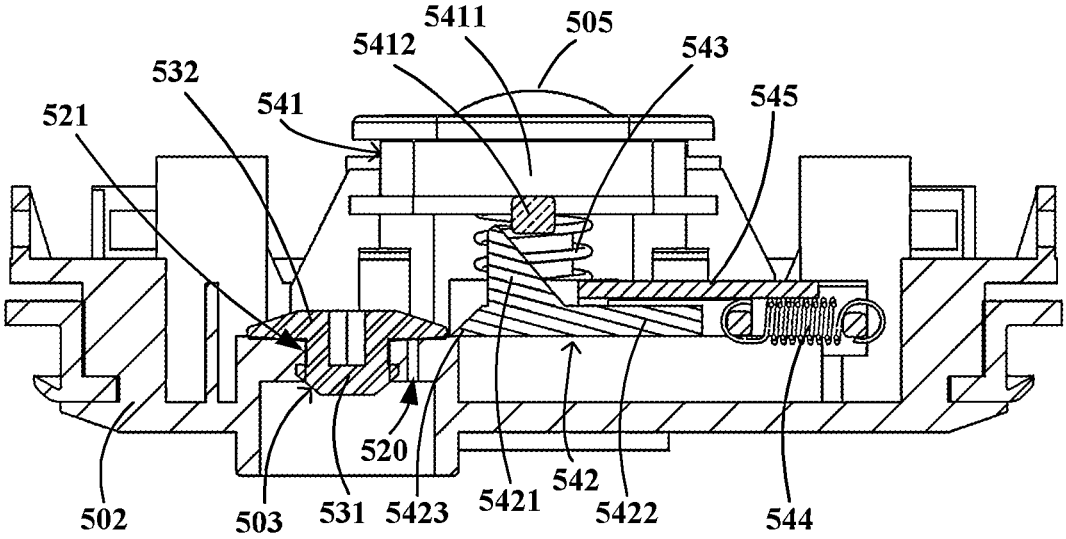
FIG. 10: Sectional view of partial components of the lid of the vacuum storage device shown in FIG. 9.
Figure 11:
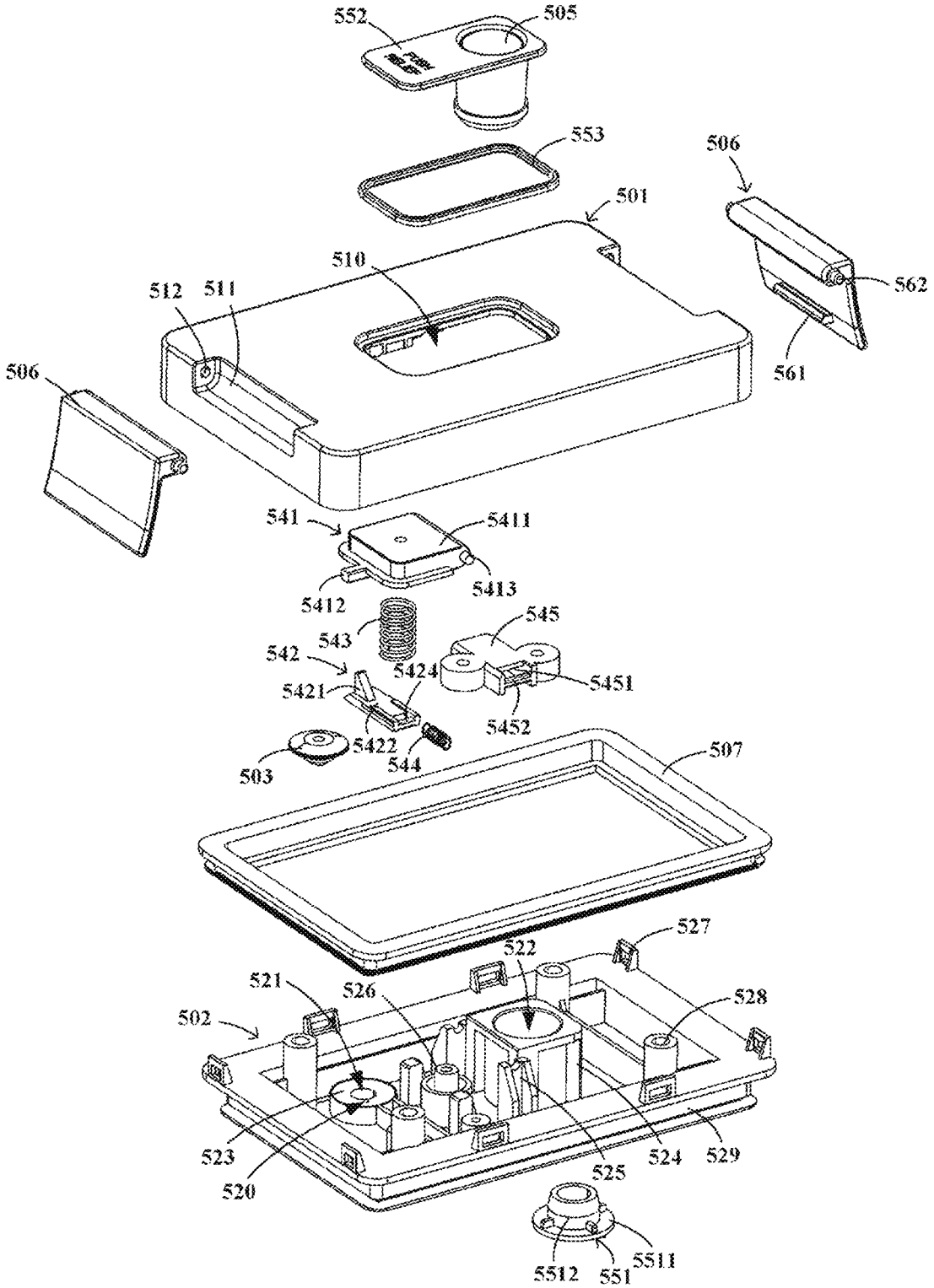
FIG. 11: Exploded view of the lid of the vacuum storage device shown in FIG. 3.

FIG. 9 depicts a schematic of some components of the lid 500 of the vacuum storage device 200 shown in FIG. 3. FIG. 10 is a sectional schematic of some components of the lid 500 of the vacuum storage device 200 shown in FIG. 9. FIG. 11 is an exploded view of the lid 500 of the vacuum storage device 200 shown in FIG. 3. In some embodiments, the storage box 400 further comprises a lid 500, designed to seal and detachably fix to the outer box 402, thereby opening and closing the storage space 410. The lid 500 is equipped with a pressurized inflation structure and/or an air pressure indication structure. The pressurized inflation structure allows external air to enter the storage space 410, while the air pressure indication structure displays the vacuum status inside the storage space 410.

As shown in FIG. 3, the lid 500 comprises an upper cover 501 and a lower cover 502, the lower cover 502 fixed to the upper cover 501. As illustrated in FIG. 11, the lower cover 502 has multiple latching protrusions 527 and fixing columns 528, with corresponding hooks (not shown in the figure) and fixing holes on the upper cover 501. The hooks engage with the latching protrusions, and the fixing columns fit into the fixing holes, securing the lower cover 502 to the upper cover 501. Additionally, an annular groove 529 is provided around the lower part of the lower cover 502, with a sealing ring 507 placed in the groove to ensure a seal between the lid 500 and the outer box 402.

In some embodiments, the pressurized inflation structure mainly consists of an inflation valve 503 and a pressing unit. The lower cover 502 has an air inlet hole 520 running through it. The inflation valve 503 is located at the air inlet hole 520 to open or close the air inlet hole 520. The pressing unit is positioned between the upper cover 501 and the inflation valve 503 and is configured such that pressing this unit moves the inflation valve 503 away from the air inlet hole 520, opening the air inlet hole 520 to allow external air into the storage space 410.

As shown in FIG. 10, the lower cover 502 also has a first mounting port 521. The inflation valve 503 has a mounting part 531 and a shielding part 532, the mounting part 531 inserted into the first mounting port 521 to fix the inflation valve 503 to the lower cover 502. The shielding part 532 is configured to abut or move away from the air inlet hole 520 to close or open the air inlet hole 520. As depicted in FIG. 11, the lower cover 502 has an inflation protrusion 523 with the first mounting port 521 in its center and the air inlet hole 520 around its edge. The mounting part 531 of the inflation valve 503 is inserted into the first mounting port 521 and latches onto the lower surface of the lower cover 502; the shielding part 532 covers the upper surface of the air inlet hole 520.

The pressing unit comprises a first movable part 541 and a second movable part 542. The first movable part 541 is configured to move up and down within the lower cover 502 and has a pressing part 5411 and a main driving part 5412, the pressing part 5411 positioned near the upper cover 501 and the main driving part 5412 on the side of the pressing part 5411 closest to the inflation valve 503. The second movable part 542 is positioned below the main driving part 5412 and on one side of the inflation valve 503. The pressing unit is configured such that pressing the pressing part 5411 of the first movable part 5411 moves the main driving part 5412 up and down, which in turn moves the second movable part 542 sideways to approach and push the inflation valve 503 away from the air inlet hole 520. As shown in FIG. 11, the lower cover 502 is provided with a support column 525, with one side of the pressing part 5411 of the first movable part 541 opposite the main driving part 5412 forming a pivot 5413, which fits into an arc-shaped slot at the top of the support column 525. The main driving part 5412 is rod-shaped.

As shown in FIG. 10, the second movable part 542 comprises a first auxiliary driving part 5421 and a second auxiliary driving part 5422. The first auxiliary driving part 5421 has an inclined surface structure, positioned below the main driving part 5412. The second auxiliary driving part 5422 is located below the first auxiliary driving part 5421, and has a sharp head 5423 at the end near the inflation valve 503. The second movable part 542 uses this sharp head 5423 to lift the inflation valve 503 upwards, thereby opening the air inlet hole 520. The arrangement of the first and second movable parts (541 and 542) translates the user's vertical pressing motion into the lateral movement of the second movable part 542. When the sharp head 5423 of the second movable part 542 approaches the shielding part 532 of the inflation valve 503, it lifts the corresponding area of the shielding part 532 upwards, thus opening the air inlet hole 520.

The pressing unit also comprises a pressing spring 543 and a traction spring 544. The pressing spring 543 is sandwiched between the pressing part 5411 and the lower cover 502. The traction spring 544 is positioned on the side of the second movable part 542 away from the inflation valve 503, one end of the traction spring 544 connected to the second movable part 542 and the other end connected to the lower cover 502) for pulling the second movable part 542 away from the inflation valve 503 after inflation is completed. As shown in FIG. 11, the lower cover 502 is provided with a positioning column 526, around which the pressing spring 543 is fitted.

Additionally, the pressing unit comprises a guiding component 545, located inside the lower cover 502. The guiding component 545 has a guiding slot 5451 along the left and right directions, and the second auxiliary driving part 5422 fits within the guiding slot 5451 and moves within this guiding slot 5451 along the left and right directions. One end of the traction spring 544 is connected to the second auxiliary driving part 5422, and the other end is connected to the guiding component 545. As illustrated in FIG. 11, the end of the guiding component 545 away from the inflation valve 503 forms a fixed edge 5452, and the end of the second auxiliary driving part 5422 away from the inflation valve 503 forms a fixed edge 5424. One end of the traction spring 544 is connected to the fixed edge 5452 of the guiding component 545, and the other end is connected to the fixed edge 5424 of the second auxiliary driving part 5422.

In some embodiments, the air pressure indication structure primarily consists of an air pressure indicator column 505 and a mounting component 551. The lower cover 502 has a second mounting port 522 that runs through it vertically. The lid 500 of this embodiment of the invention also comprises the air pressure indicator column 505, positioned at the second mounting port 522. The air pressure indicator column 505 is a hollow structure with an opening at the bottom and is at least partially made of a flexible deformable material at its top area, allowing the degree of deformation of this flexible structure to indicate the vacuum status inside the storage space 410. Specifically, the upper cover 501 has a third mounting port 510 running through it vertically, where the projection of the third mounting port 510 on a horizontal plane covers the second mounting port 522, allowing the top area of the air pressure indicator column 505 to be exposed outside the upper cover 501. The mounting component 551 comprises a bottom wall part 5511 and a side wall part 5512, the bottom wall part 5511 is provided with multiple ventilation holes (5510) along up and down direction, the side wall part 5512 is inserted and fixed inside the air pressure indicator column 505 from the bottom opening of the air pressure indicator column 505. In the non-vacuumed state, the flexible structure of the air pressure indicator column 505 naturally extends and protrudes above the surface of the upper cover 501, as shown in FIG. 10. During vacuuming, the flexible structure of the air pressure indicator column 505 gradually contracts and moves downwards. When the top surface of the air pressure indicator column 505 is flush with the upper surface of the upper cover 501, it indicates that vacuuming is complete. Over time, if the vacuum level inside the storage space 410 decreases to a certain extent, the flexible structure of the air pressure indicator column 505 will extend upwards again. Thus, the degree of deformation of the flexible structure of the air pressure indicator column 505 can indicate the vacuum status inside the storage space 410. As shown in FIG. 11, the lower cover 502 may have a support frame 524 that works in conjunction with the air pressure indicator column 505.

The lid 500 of this embodiment also comprises a pressing top plate 552, positioned at the third mounting port 510, integrating one side with the air pressure indicator column 505, and the other side located above the pressing unit for the user to press. The pressing top plate 552 and the air pressure indicator column 505 can be made of a single elastic component. As shown in FIG. 11, a sealing ring 553 is placed between the pressing top plate 552 and the third mounting port 510.

In this embodiment of the invention, the lid 500 also comprises at least one pair of movable latch ears 506. The upper part of each movable latch car 506 is pivotally connected to the upper cover 501 or lower cover 502, and the inner side of the lower part is provided with a fixed protrusion 561. The upper part of the outer box 402 has corresponding fixed protrusions 423 that engage with the fixed protrusions 561 of the movable latch cars 506, securing the lid 500 to the box part. As shown in FIG. 11, the top of each movable latch ear 506 forms a pivot 562, and each side of the upper cover 501 has a receiving slot 511 with pivot holes 512 on both sides, into which the pivots 562 fit.

In the description of this embodiment, it should be understood that the terms "upper," "lower," "front," "back," "left," "right," and similar directional or positional references used for the vacuum storage device 200 are based on the orientation or position relationships as shown in FIG. 3. These terms are used only for ease of description of the invention and to simplify the explanation, and are not intended to indicate or imply that the devices or components referred to must have a specific orientation, be constructed and operated in a specific orientation, and should not be construed as a limitation on the invention.

With this in mind, those skilled in the art should recognize that, although this document has shown and described several exemplary embodiments of the invention in detail, many other variations or modifications can be made or derived directly based on the disclosed content of the invention without departing from the spirit and scope of the invention. Therefore, the scope of the invention should be understood and recognized to cover all such other variations or modifications.

What is claimed is:

1. A vacuum storage device, comprising:

a suction base, which is provided with a first suction port;

a storage box configured to be detachably fixed to the suction base, defining a storage space within; where the storage box has a suction port;

a vacuum pump configured to sequentially extract part or all of the air from the storage space through the first suction port and the suction port, wherein:

the storage box comprises an inner box and an outer box, the inner box defining the storage space;

the outer box is fitted over the inner box and has a gap between the outer box and the inner box, the outer box is provided with the suction port, and the vacuum pump sequentially extracting part or all of the air from the storage space through the first suction port, the suction port, and the gap.

2. The vacuum storage device according to claim 1, wherein:

the top wall of the suction base is provided with the first suction port;

the suction base further comprises a base suction switch positioned at the first suction port, configured to: when the storage box is placed at the first suction port, the base suction switch moves downward due to the weight of the storage box, forming a suction channel with the first suction port; when the storage box is removed from the suction base, the base suction switch moves upward and closes the first suction port.

3. The vacuum storage device according to claim 2, wherein:

the base suction switch comprises a valve, a first spring, and a first sealing ring; where the valve has a horizontal part and a vertical part extending downward from the horizontal part, the vertical part of the valve passes through the first suction port, with an outer diameter smaller than the inner diameter of the first suction port and forming an annular groove at the bottom;

the first spring is fitted around the outside of the vertical part of the valve and sandwiched between the horizontal part of the valve and the top wall of the suction base;

the first sealing ring is provided within the annular groove and having an outer diameter greater than the inner diameter of the first suction port.

4. The vacuum storage device according to claim 1, wherein:

the bottom wall of the outer box is provided with the suction port;

the bottom wall of said outer box extending downwardly around the suction opening to form at least one switch protrusion such that when the storage box is placed within the suction base, the switch protrusion abuts the horizontal portion of the valve and pushes the base suction switch downwardly.

5. The vacuum storage device according to claim 1, wherein:

the bottom wall of the outer box is provided with the suction port;

the storage box further comprises a box suction switch, positioned at the suction port, where the box suction switch is an elastic component, configured to: when the vacuum pump is activated, the box suction switch moves downward due to suction to form a suction channel with the suction port; after vacuuming is completed, the box suction switch moves upward to close the suction port.

6. The vacuum storage device according to claim 1, wherein:

the storage box further comprises a lid, configured to be detachably sealed and fixed to the outer box, to opening and closing the storage space; wherein the lid is provided with a pressurized inflation structure and/or an air pressure indication structure, the pressurized inflation structure allowing external air to enter the storage space, and the air pressure indication structure displaying the vacuum status inside the storage space.

7. The vacuum storage device according to claim 1, wherein:

the suction base defines an accommodation space, with the vacuum pump located within this accommodation space.

8. A refrigerator comprising the vacuum storage device according to claim 1.

* * * * *